US006744205B2

(12) United States Patent
Iida et al.

(10) Patent No.: US 6,744,205 B2
(45) Date of Patent: Jun. 1, 2004

(54) DISCHARGE LAMP WITH IMPROVED LIGHT DISTRIBUTION CHARACTERISTICS

(75) Inventors: Shiro Iida, Kyoto (JP); Noriyuki Uchida, Hirakata (JP); Kenji Nakano, Kyoto (JP); Tatsuhiro Yabuki, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/251,224

(22) Filed: Sep. 20, 2002

(65) Prior Publication Data

US 2003/0067271 A1 Apr. 10, 2003

(30) Foreign Application Priority Data

Sep. 26, 2001 (JP) ..... 2001-293834
Sep. 26, 2001 (JP) ..... 2001-293835

(51) Int. Cl.[7] ..... H01J 17/16; H01J 61/33; H01J 61/30

(52) U.S. Cl. ..... 313/634; 313/573; 313/493; 220/2.1 R; 362/216

(58) Field of Search ..... 313/493, 573, 313/634, 635, 636, 317; 220/2.1 R; 362/216; D26/1, 2, 3

(56) References Cited

U.S. PATENT DOCUMENTS 5,751,104 A 5/1998 Soules et al. ..... 313/493
D432,687 S 10/2000 Choi ..... D26/3
6,633,128 B2 * 10/2003 Ilyes ..... 313/634

FOREIGN PATENT DOCUMENTS

| | | |
|---|---|---|
| DE | 3544465 | 6/1986 |
| DE | 4133077 | 4/1993 |
| JP | 58048349 A | 3/1983 |
| JP | 61-148759 | 7/1986 |
| JP | 2-97746 | 1/1989 |
| JP | 08087981 A | 4/1996 |
| JP | 8-339780 | 12/1996 |
| JP | 1074767 | 6/2000 |
| JP | 1094176 | 12/2000 |
| JP | 1099891 | 2/2001 |
| JP | 1099892 | 2/2001 |

* cited by examiner

*Primary Examiner*—Nimeshkumar D. Patel
*Assistant Examiner*—Mariceli Santiago

(57) ABSTRACT

Disclosed is a discharge lamp with enhanced vertical illuminance and accordingly improved light distribution characteristics that is easy to manufacture and suitable for mass production. For a discharge lamp in which a discharge path with a double helix configuration is formed or a discharge lamp in which a plurality of U-shaped tubes are placed on an arc tube holder to form a single tortuous discharge path, a width of a turning part 106 is specified so as to narrow spaces formed in an arc tube top part, or swelling parts are provided in a vicinity of the arc tube top part so as to narrow the spaces.

15 Claims, 15 Drawing Sheets

DISCHARGE LAMP WITH IMPROVED LIGHT DISTRIBUTION CHARACTERISTICS

This application is based on Patent Application Nos. 2001-293834 and 2001-293835 filed in Japan, the contents of which are hereby incorporated by reference.

BACKGROUND OF THE INVENTION

1. Field of the Invention

The present invention relates to a discharge lamp with improved light distribution characteristics.

2. Description of Related Art

Examples of conventional discharge lamps include a lamp using a double helical arc tube in which a discharge path with a double helix configuration is formed and electrodes are provided at both ends of the discharge path (first conventional technique), and a lamp using an arc tube composed of a plurality of U-shaped tubes (e.g., three U-shaped tubes) whose side edges are connected with one another to form a single tortuous discharge path and electrodes are provided at both ends of the discharge path (second conventional technique).

FIGS. 1 and 2 are for describing the first conventional technique. FIG. 1 is a top view of a discharge lamp 901 relating to the first conventional technique as viewed from the top of an arc tube. FIG. 2 is a side view of the discharge lamp 901. As shown in FIG. 1, a top part of the arc tube of the discharge lamp 901 has the following shape. The arc tube top part is composed of a turning part 906 that is provided at the center of the arc tube top part and helical parts 907 that are provided to sandwich the turning part 906 between them. In the arc tube top part, spaces 908 are formed between the turning part 906 and the respective helical parts 907.

FIGS. 3 and 4 are for describing the second conventional technique. FIG. 3 is a top view of a discharge lamp 920 relating to the second conventional technique as viewed from the top of an arc tube. FIG. 4 is a side view of the discharge lamp 920. The discharge lamp 920 relating to the second conventional technique includes an arc tube composed of three U-shaped tubes 921, 922, and 923. The U-shaped tubes 921 and 922, and the U-shaped tubes 922 and 923 are respectively connected with each other at their side edges, thereby forming a single tortuous discharge path. A pair of electrodes (not shown) is provided at both ends of the discharge path. The discharge lamp 920 further includes an arc tube holder 924 that holds a bottom part of the arc tube. The three U-shaped tubes are set straight and provided annularly so as to surround the axis of the arc tube holder 924.

The discharge lamps described above can be used as alternative light sources to incandescent electric lamps. However, these discharge lamps have problems in their light distribution characteristics. To be more specific, the discharge lamps relating to the above conventional techniques exhibit lower illuminance in the direction of the arc tube top (hereafter referred to as "vertical illuminance") than incandescent lamps.

Light distribution characteristics are to indicate distribution of light outputs. A discharge lamp has a base usually provided at a bottom part of an arc tube that is opposite to an arc tube top part, and is set with the arc tub top part being oriented downward. When used as ceiling area lighting of a room, a discharge lamp with high vertical illuminance can lighten the whole room brightly, but a discharge lamp with low vertical illuminance can lighten the whole room only dimly due to light escaping in the horizontal direction. To sum up, there are increasing demands for improving vertical illuminance of discharge lamps.

Also, various efforts have been made to improve light distribution characteristics of discharge lamps relating to the second conventional technique that include a plurality of connected U-shaped tubes. One example of such efforts is a lamp in which a top part of an arc tube is bent toward an axis of an arc tube holder, and another example is a lamp in which an arc tube is inclined with respect to an arc tube holder (see e.g., Japanese published unexamined patent application No. S58-48349 and Japanese published unexamined utility model application No. H2-97746).

In fact, the arc tube whose top part is bent is difficult to manufacture and is not suitable for mass production because it needs a mold with a complex shape and requires a complicated work of inserting a softened glass tube into the mold in its manufacturing processes. Also, the arc tube that is set inclined inevitably increases the whole lamp size and lacks in compactness because an angle of inclination needs to be set large and a distance between both ends of the arc tube increases accordingly.

SUMMARY OF THE INVENTION

The object of the present invention therefore is to provide a discharge lamp with improved light distribution characteristics that is easy to manufacture and suitable for mass production.

The above object can be achieved by a discharge lamp, including: an arc tube holder; and a double helical arc tube whose both ends are held by the arc tube holder, and that includes a turning part at a top thereof and two helical parts, the turning part joining the two helical parts together, wherein a tube diameter of the turning part gradually increases toward a middle of the, turning part, in such a direction that narrows a non light-emitting region formed between the turning part and a neighboring portion of each helical part at the top of the arc tube.

According to the construction of the discharge lamp in which spaces formed at both sides of the turning part can be narrowed by adjusting a width of the turning part, light distribution characteristics can be improved. Also, in manufacturing processes of this discharge lamp, the width of the turning part can be adjusted, for example, by blowing air or the like into a glass tube that is in a softened state. Therefore, a normal metal mold can be used in the manufacturing processes. As a result, this discharge lamp is easy to manufacture and suitable for mass production.

The above object can also be achieved by a discharge lamp, including: an arc tube holder; and an arc tube that includes a plurality of U-shaped tubes placed on the arc tube holder, predetermined ones of the U-shaped tubes being connected together, to form a single discharge path therein, wherein each U-shaped tube has a swelling part at a top thereof that is an opposite side to the arc tube holder, to narrow a non light-emitting region surrounded by tops of the plurality of U-shaped tubes.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENTS (First Embodiment)

Figure 1:
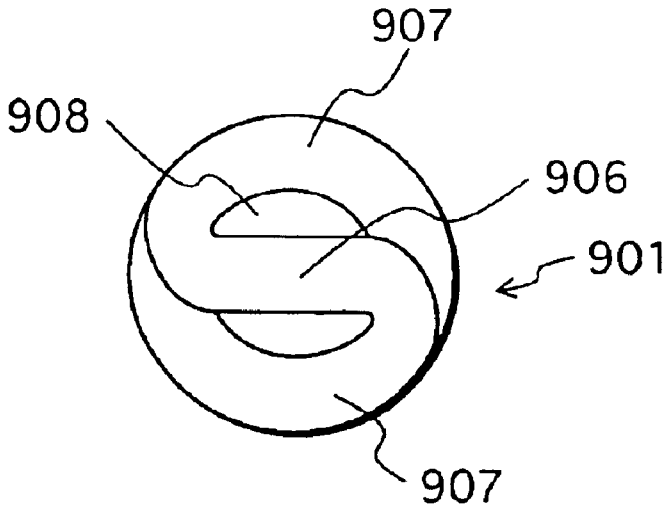
FIG. 1 PRIOR ART
FIG. 1 is a top view for describing a discharge lamp relating to a first conventional technique.
Figure 2:
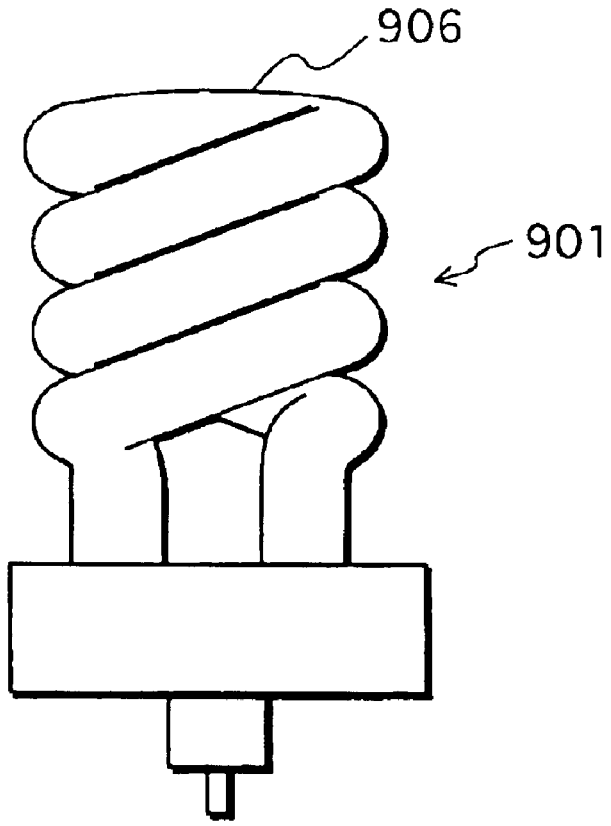
FIG.2 PRIOR ART
FIG. 2 is a side view for describing the discharge lamp relating to the first conventional technique.
Figure 3:
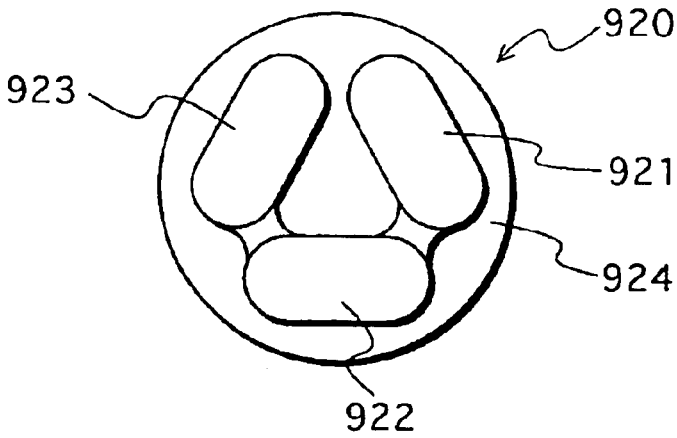
FIG.3 PRIOR ART
FIG. 3 is a top view for describing a discharge lamp relating to a second conventional technique.
Figure 4:
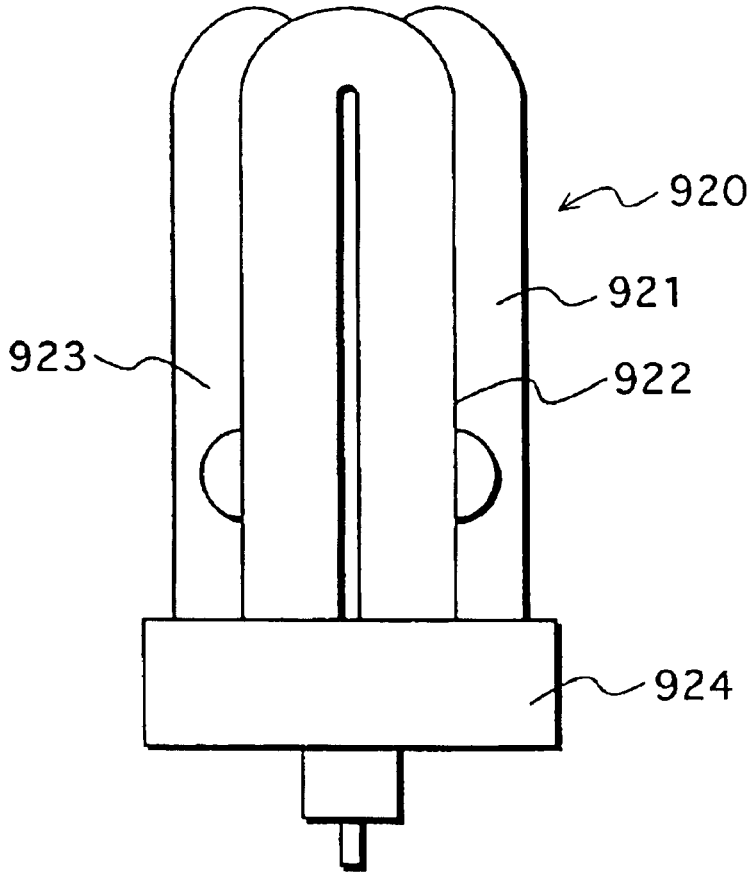
FIG.4 PRIOR ART
FIG. 4 is a side view for describing the discharge lamp relating to the second conventional technique.
Figure 5:
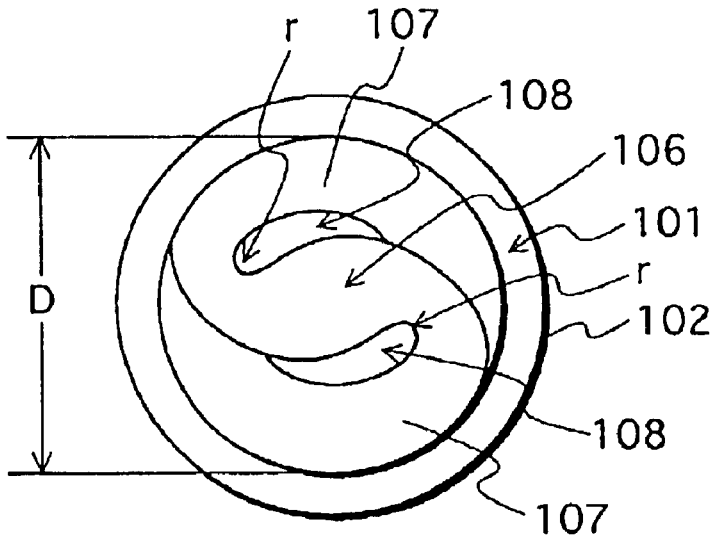
FIG. 5 is a top view showing the construction of a fluorescent lamp relating to a first embodiment of the present invention.
Figure 6:
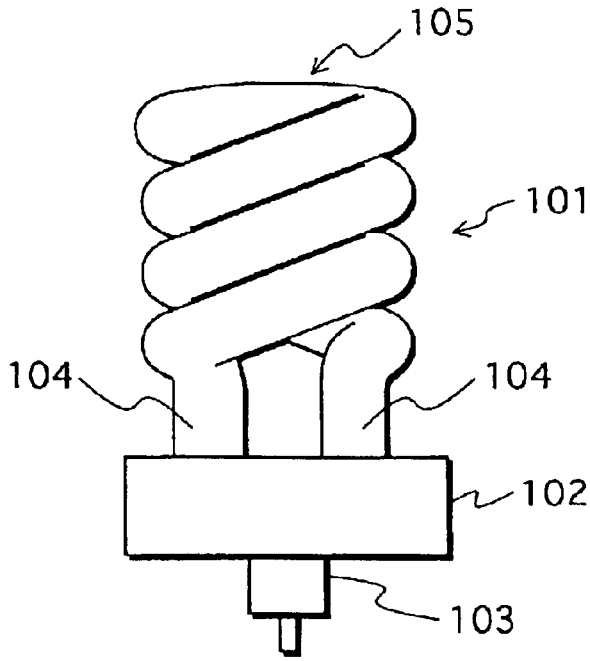
FIG. 6 is a side view showing the construction of the fluorescent lamp relating to the first embodiment of the present invention.

The following describes a first embodiment of the present invention, with reference to the drawings. FIGS. 5 and 6 show the construction of a fluorescent lamp as one example of a discharge lamp relating to the present embodiment. FIG. 5 is a top view of the fluorescent lamp relating to the present embodiment as viewed from the top of an arc tube. FIG. 6 is a side view of the fluorescent lamp. The fluorescent lamp relating to the present embodiment has the following construction. A double helical arc tube 101 that includes a light-emitting part and both-end parts 104 is held by an arc tube holder 102 that includes a base 103. In the arc tube 101, the light-emitting part has a helical discharge path, and the both-end parts 104 have electrodes (not shown) being provided there and extend from the light-emitting part. The both-end parts 104 extend substantially parallel in the same direction.

The following describes a shape of an arc tube top part 105 that is positioned opposite to the both-end parts 104. The arc tube top part 105 is composed of a turning part 106 that is provided at the center of the arc tube top part 105, and helical parts 107 that are provided to sandwich the turning part 106 between them. In the arc tube top part 105, spaces 108 are formed between the turning part 106 and the respective helical parts 107.

In the present embodiment, the turning part 106 is shaped in such a manner that its tube diameter at least in such a direction to occupy the spaces 108 gradually increases from each of both ends of the turning part 106 toward its middle vicinity. Due to this, the spaces 108 (non light-emitting regions formed between the turning part 106 and neighboring portions of the helical parts 107) are narrowed as compared with the case of the above first conventional technique.

In the fluorescent lamp relating to the present embodiment, a tube diameter of the turning part 106 of the arc tube is specified as described above to narrow the spaces 108, aiming at enhancing vertical illuminance and improving light distribution characteristics.

The arc tube 101 in the present embodiment is constructed by a glass tube with an outer tube diameter of 9 mm, to form a discharge path with a double helix configuration therein. The maximum outer tube diameter of the turning part 106 is in a range of 12 to 14 mm. This means that the maximum outer tube diameter of the turning part 106 is larger than the outer tube diameter of an unprocessed glass tube by approximately 3 to 5 mm. Here, the diameter "D" of the double helical parts viewed from the top of the arc tube (see FIG. 5) is 36 mm. It is preferable to specify the diameter "D" in a range of 30 to 40 mm inclusive, although the diameter "D" is not necessarily limited to this range. In a process of forming the turning part 106 in accordance with a manufacturing method described later, the tube diameter of the turning part 106 may become thinner at its both ends than that of the unprocessed glass tube. The tube diameter of the turning part 106 at its both ends is not particularly limited, whereas the radius of curvature "R" of the inside of the glass tube (at the side of each space 108) (the part indicated by "r" in the figure) is specified in a range of approximately 1.8 to 2.0.

Figure 7C:
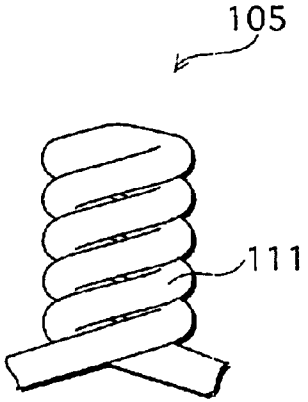
FIGS. 7A to 7C are for describing a manufacturing method for an arc tube in the first embodiment.
Figure 7B:
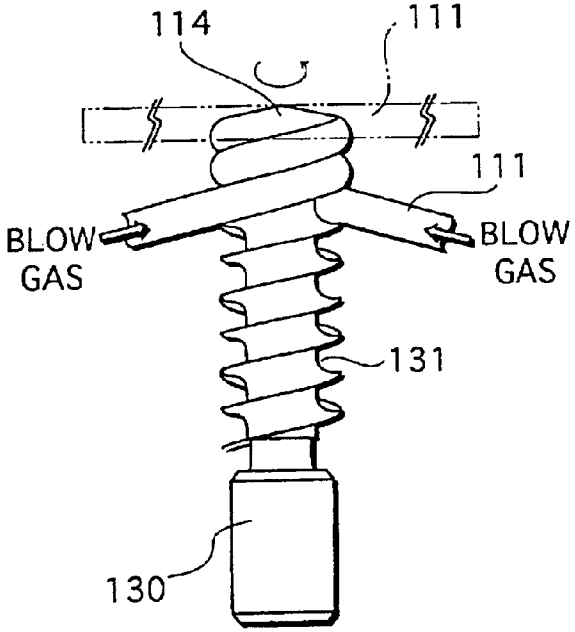
Figure 7A:
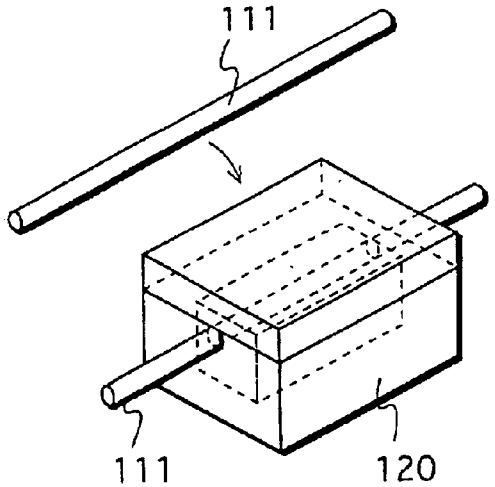

The following describes a manufacturing method for the fluorescent lamp relating to the present embodiment, by particularly focusing on a manufacturing method for the arc tube 101. FIGS. 7A to 7C are for describing the manufacturing method for the arc tube 101. For manufacturing the arc tube 101, a straight glass tube 111 as shown in FIG. 7A is first prepared. This glass tube 111 has a cross section being circular, and has an outer tube diameter of 9.0 mm and an inner tube diameter of 7.4 mm as described above. A middle part of this straight glass tube 111 (including at least a part to be bent into a double helix) is placed within a heating furnace 120 that is an electric furnace, a gas furnace, or the like as shown in FIG. 7A. The glass tube 111 is then heated to a temperature equal to or higher than a softening point of the glass tube 111 (675° C. in the present embodiment), so as to soften the glass tube 111.

The softened glass tube 111 is taken out from the heating furnace 120. As shown in FIG. 7B, an approximate center 114 of the glass tube 111 is aligned with the top of a molding fixture 130 (material: stainless steel). The molding fixture 130 is then rotated by a driving device that is not shown in the figure. This results in the softened glass tube 111 being wound up around the folding fixture 130. Here, the approximate center 114 of the glass tube 111 becomes the turning part 106.

A helical groove 131 that turns around the axis (pintle) is provided in double on the outer surface of the molding fixture 130. It should be noted here that during the work of winding the glass tube 111 around the molding fixture 130, a gas, such as nitrogen, whose pressure is controlled, is being blew into the glass tube 111 at a pressure of 10 to 50 kpa, in view of preventing the glass tube 111 from being crushed, i.e., retaining the cross section of the glass tube 111 as being substantially circular.

Then, when the temperature of the glass tube 111 decreases and the glass tube 111 that had been in a softened state is back to a hardened state, the molding fixture 130 is rotated in the direction opposite to the direction at the time of winding the glass tube 111, so as to detach the glass tube 111 that has been shaped into a double helix from the molding fixture 130 (see FIG. 7C).

Following this, electrodes are attached to the both-end parts of the glass tube 111, the glass tube 111 is set on the arc tube holder 102, and the base 103 is attached to the arc tube holder 102, to complete manufacturing of the fluorescent lamp.

As described above, the fluorescent lamp relating to the present embodiment is characterized in that the turning part 106 is shaped in such a manner that its width at least in the direction to occupy the spaces 108 gradually increases from each of both ends of the turning part 106 toward its middle vicinity, and accordingly the spaces 108 formed between the turning part 106 and the respective helical parts 107 can be narrowed. Due to this, vertical illuminance can be enhanced and light distribution characteristics can be improved.

(Second Embodiment)

The following describes a fluorescent lamp relating to a second embodiment of the present invention. In view of improving light distribution characteristics of the lamp, swelling parts are provided at both sides of a turning part 106 so as to narrow spaces 108 in the present embodiment.

Figure 8:
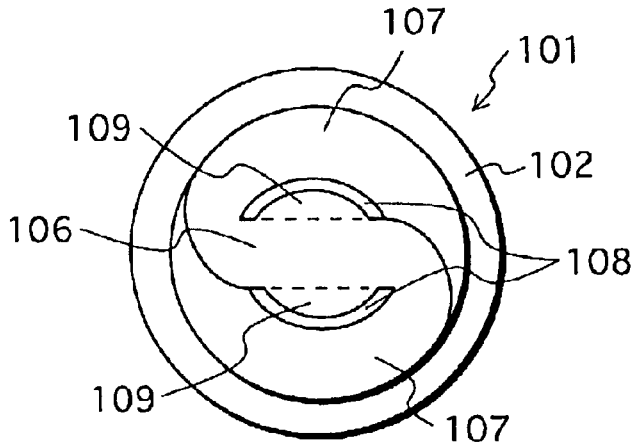
FIG. 8 is a top view showing the construction of a fluorescent lamp relating to a second embodiment of the present invention.
Figure 9:
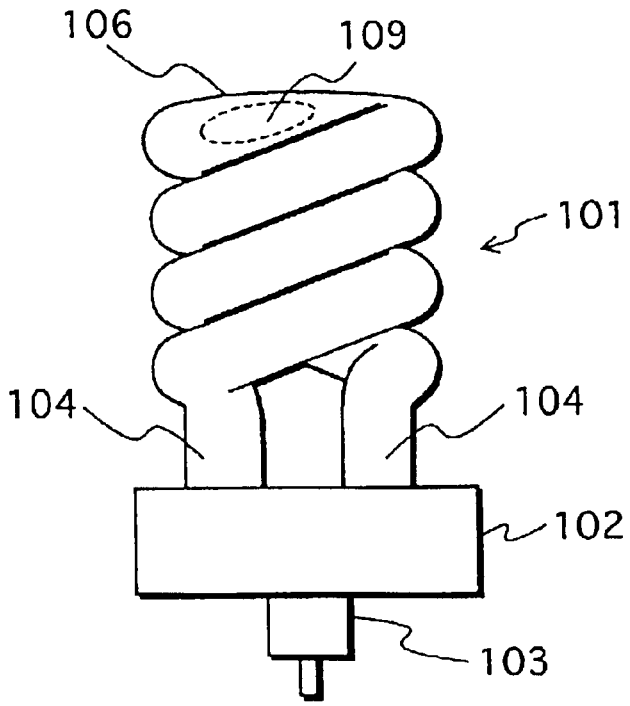
FIG. 9 is a side view showing the construction of the fluorescent lamp relating to the second embodiment of the present invention.

As shown in FIGS. 8 and 9, the fluorescent lamp relating to the present embodiment has basically the same construction as the lamp relating to the first embodiment, with the difference being in the following points. In the present embodiment, the swelling parts 109 swelling toward the spaces 108 are provided at both sides of the turning part 106, whereas in the first embodiment the turning part 106 is formed in such a manner that its width 106 gradually increases.

By providing the swelling parts 109 in this way, too, the spaces 108 formed between the turning part 106 and the respective helical parts 107 can be narrowed, thereby expanding a light-emitting area of the top part of the arc tube. Therefore, the lamp can exhibit improved vertical illuminance when the lamp is lit with the arc tube top part being oriented downward.

The following describes one example of a method for forming the swelling parts 109 relating to the present invention. Such a metal mold for processing a tube as described in the first embodiment is provided with depressions corresponding to the swelling parts 109. While the glass tube in a softened state is being processed using this metal mold, air is injected into the glass tube. By doing this, parts of the glass tube are fit into the depressions of the metal mold, so as to form the swelling parts 109. Here, it is preferable to inject air after the glass tube is completely wound up into a double helix.

Figure 10:
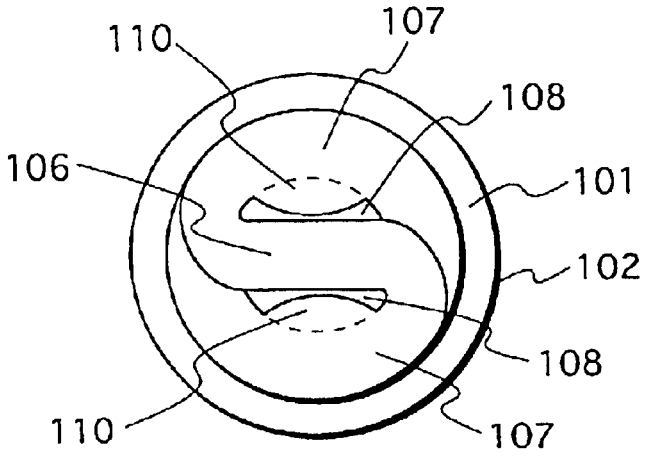
FIG. 10 is a top view showing the construction of another fluorescent lamp relating to the second embodiment of the present invention.
Figure 11:
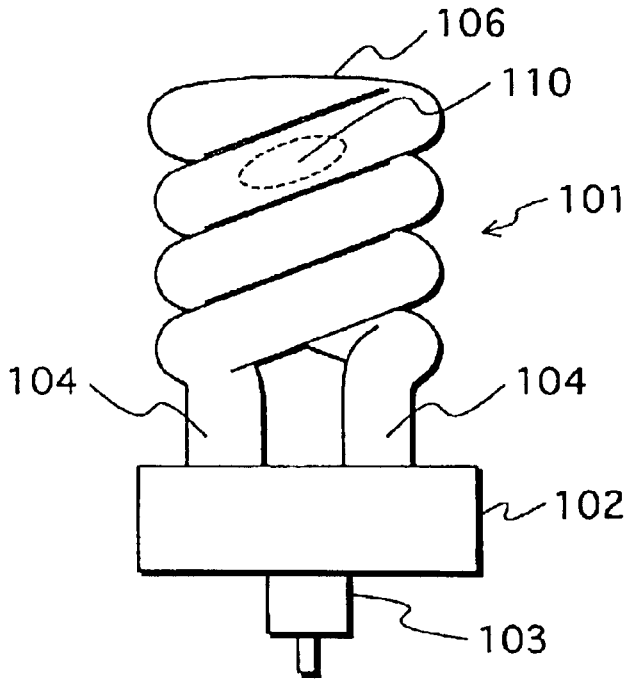
FIG. 11 is a side view showing the construction of the other fluorescent lamp relating to the second embodiment of the present invention.

It should be noted here that although the swelling parts 109 are provided at both sides of the turning part 106 to narrow the spaces 108 in the present embodiment, swelling parts 110 may instead be provided respectively at the helical parts 107 that sandwich the turning part 106 between them in the vicinity of the arc tube top part as shown in FIGS. 10 and 11, to narrow the spaces 108. This construction may seem to be disadvantageous in that the tube-processing metal mold cannot be detached as it is after the swelling parts 110 are formed. However, a different manufacturing method may be used for this construction. For example, a metal mold that is dividable into a plurality of parts may be used. With such a method, too, the effect of improving light distribution characteristics can be obtained as in the case of the lamp relating to the present embodiment.

Measurements of vertical illuminance were conducted on the fluorescent lamp in the present embodiment (hereafter referred to as the "lamp of the present invention"), a fluorescent lamp relating to the first conventional technique, and an incandescent lamp. The measurement results are shown in FIG. 12.

Figure 12:
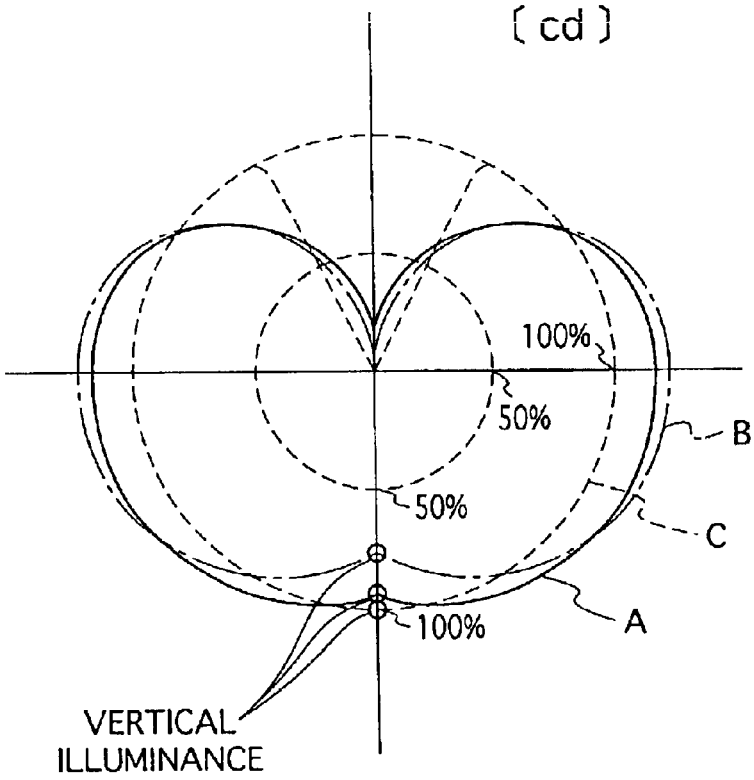
FIG. 12 is for describing light distribution characteristics of the fluorescent lamp relating to the second embodiment of the present invention.

It should be noted here that an electronic lighting circuit with a power supply voltage of 100V and a lamp power of 12W was used for the lamp of the present invention used for the measurements shown in FIG. 12. An arc tube 101 with an outer tube diameter of 10 mm was used. The maximum value for the outer tube diameter of the arc tube top part of the glass tube where the swelling parts 110 are provided is 10 mm, plus 3 to 5 mm corresponding to the swelling parts 110.

It should be noted here that the fluorescent lamp without having the swelling parts 110 in the arc tube top part (hereafter referred to as the "conventional lamp", see the above first conventional technique) was assessed using the same specifications as those for the lamp of the present invention. Also, as the incandescent lamp of a comparative example, a lamp having a lamp power of 60W was used. Assuming light distribution characteristics of this incandescent lamp as 100%, light distribution characteristics of each lamp in terms of a vertical plane were measured. The measurements of light distribution characteristics were conducted in the following way. Each lamp was set with the arc tube top part being oriented upward, and lit in a calm state at an ambient temperature of 25° C. Illuminance of each lamp was measured using an illuminance meter. In the figure, illuminance at the side of the arc tube top part is shown downward.

Light distribution characteristics of the lamp of the present invention (indicated by letter "A") are shown together with light distribution characteristics of the incandescent lamp (indicated by letter "C"), and light distribution characteristics of the conventional lamp (indicated by letter "B") in FIG. 12.

As can be seen clearly from FIG. 12, the vertical illuminance of the lamp of the present invention is improved as compared with that of the conventional lamp, and is closer to that of the incandescent lamp. As such, the lamp of the present invention can be regarded as a discharge lamp suitable as an alternative to an incandescent lamp.

It should be noted here that although the light distribution characteristics shown in FIG. 12 are for the lamp shown in FIGS. 10 and 11, similar results can be obtained for the lamp relating to the first embodiment and the lamp shown in FIGS. 8 and 9. This is because the light distribution characteristics are mainly determined by the degree of narrowing the spaces 108.

(Third Embodiment)

Figure 13:
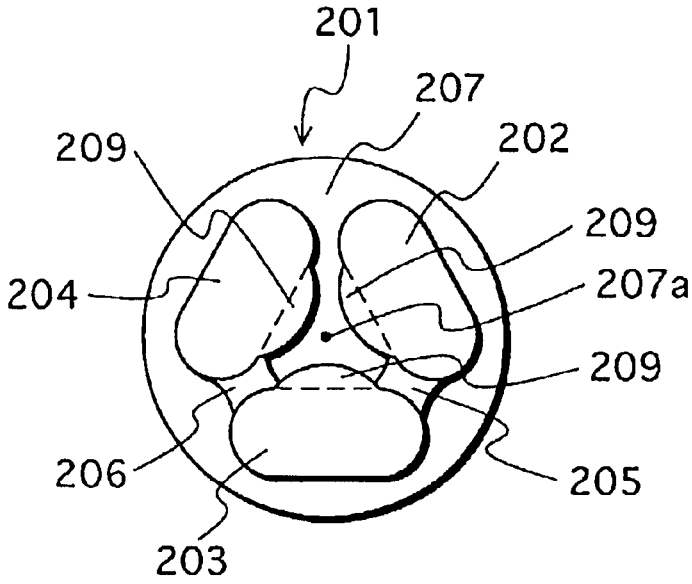
FIG. 13 is a top view showing the construction of a fluorescent lamp relating to a third embodiment of the present invention.
Figure 14:
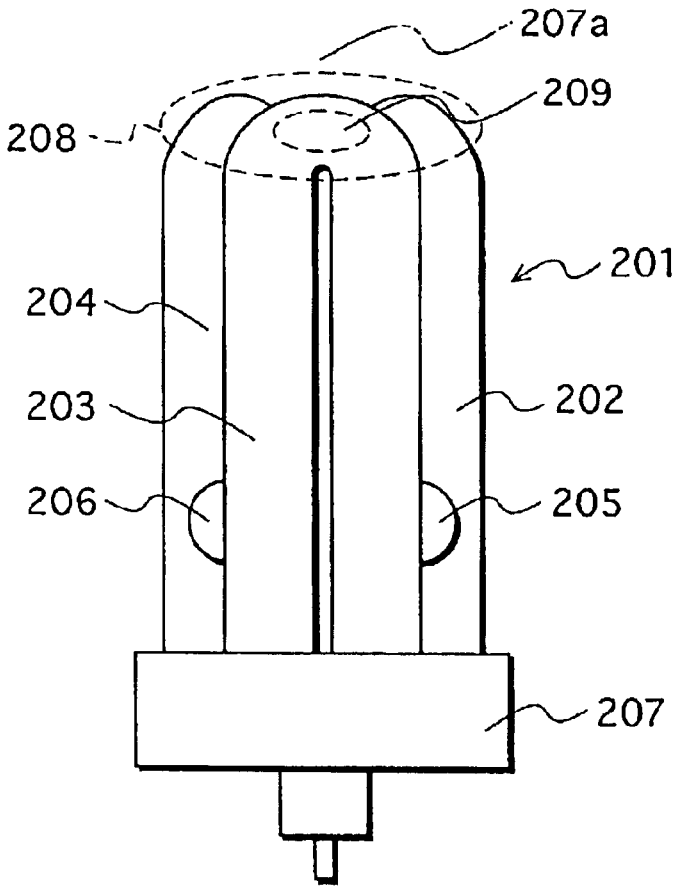
FIG. 14 is a side view showing the construction of the fluorescent lamp relating to the third embodiment of the present invention.

The following describes a third embodiment of the present invention. The present embodiment describes a method for improving light distribution characteristics of a discharge lamp relating to the second conventional technique described above. FIGS. 13 and 14 show the construction of a fluorescent lamp as one example of the discharge lamp relating to the present embodiment. FIG. 13 is a top view of the fluorescent lamp as viewed from the top of an arc tube. FIG. 14 is a side view of the fluorescent lamp.

The fluorescent lamp relating to the present embodiment includes an arc tube 201 and an arc tube holder 207. The arc tube 201 is composed of three U-shaped tubes 202, 203, and 204 each formed by processing a glass tube. The U-shaped tubes 202, 203, and 204 are connected with one another at their side edges via bridge-connecting parts 205 and 206, so as to form a single tortuous discharge path at both-end parts of which a pair of electrodes (not shown) are provided. The arc tube holder 207 holds the both-end parts of the arc tube 201.

The arc tube 201 has the following construction. The arc tube 201 is set straight and provided annularly so as to surround an axis 207*a* of the arc tube holder 207. Also, the arc tube top part 208 that is positioned opposite to the arc tube holder 207 holding the arc tube 201 includes swelling parts 209 swelling toward the axis 207*a*. The maximum outer tube diameter of the arc tube top part 208 having the swelling parts 209 is larger than the maximum tube diameter of any other parts of the arc tube (e.g., straight parts of U-shaped tubes provided parallel to one another).

According to this construction, for example, when the lamp is lit with the arc tube holder 207 being oriented upward and the arc tube 201 being oriented downward, a part of the arc tube holder 207 surrounded by the three U-shaped tubes (a non light-emitting region) is narrowed due to the swelling parts 209 that are parts of the arc tube 201. Due to light output from the swelling parts 209, vertical illuminance can be enhanced, and accordingly, vertical illuminance of the fluorescent lamp can be enhanced.

Also, as one example, the swelling parts 209 can be formed in the following way. A tube-processing metal mold (not shown) provided with depressions corresponding to the swelling parts 209 of the arc tube top part 208 is used. A softened glass tube is placed in this metal mold and air is injected into the glass tube. By doing this, parts of the arc tube top part are fit into the depressions, so as to form the swelling parts 209 in the arc tube top part 208. With this method, deterioration in workability and yield can be prevented, thereby improving productivity and suitability for mass production.

As described above, the fluorescent lamp relating to the present embodiment too exhibits improved productivity and suitability for mass production. Moreover, a fluorescent lamp with enhanced vertical illuminance and so with improved light distribution characteristics can be obtained.

Measurements of vertical illuminance were conducted on the fluorescent lamp relating to the present embodiment (hereafter referred to as the "lamp of the present invention"), a fluorescent lamp relating to the second conventional technique (hereafter referred to as a "comparative lamp"), and an incandescent lamp. The measurement results are shown in FIG. 15.

Figure 15:
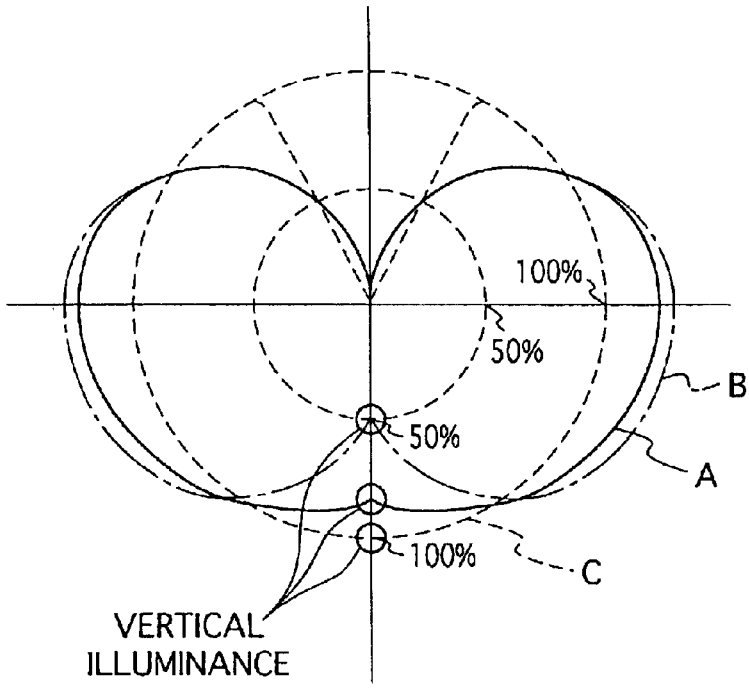
FIG. 15 is for describing light distribution characteristics of the fluorescent lamp relating to the third embodiment of the present invention.

It should be noted here that an electronic lighting circuit with a power supply voltage of 100V and a lamp power of 12W was used for the lamp of the present invention used for the measurements shown in FIG. 15. An arc tube 201 with an outer tube diameter of 10 mm was used. The maximum value for the outer tube diameter of the arc tube top part of the glass tube where the swelling parts 209 are provided is 10 mm, plus 3 to 5 mm corresponding to the swelling parts 209. It should be noted here that the fluorescent lamp without having the swelling parts 209 in the arc tube top part 208 was assessed with the same specifications as those for the lamp of the present invention. Also, as the incandescent lamp, a lamp having a lamp power of 60W was used. Assuming light distribution characteristics of this incandescent lamp as 100%, light distribution characteristics of each lamp in terms of a vertical plane were measured. The measurements of light distribution characteristics were conducted in the same manner as that for the second embodiment. Each lamp was set with the arc tube top part being oriented upward, and lit in a calm state at an ambient temperature of 25° C. lluminance of each lamp was measured using an illuminance meter.

Light distribution characteristics of the lamp of the present invention (indicated by letter "A") are shown together with light distribution characteristics of the incandescent lamp (indicated by letter "C"), and light distribution characteristics of the conventional lamp (indicated by letter "B") in FIG. 15.

As can be seen clearly from FIG. 15, the vertical illuminance of the lamp of the present invention is improved as compared with that of the comparative lamp, and is closer to that of the incandescent lamp. As such, the lamp of the present invention can be regarded as a discharge lamp suitable as an alternative to an incandescent lamp.

In the present embodiment, vertical illuminance of the lamp is improved further as the swelling parts 209 are made larger with respect to an unprocessed glass tube constituting the arc tube 201. However, if the swelling parts 209 are made larger to the extent that they are contacted with one another, the swelling parts 209 may collide with one another due to vibrations during transportation or the like. Also, if the swelling parts 209 are made too close to one another, the temperature of a spare surrounded by the tubes may increase excessively, causing such problems as thermal discoloration of the arc tube holder 207. Accordingly, it is preferable to provide the swelling parts 209 apart from one another by at least 0.5 to 3.0 mm.

<Modifications>

Although the present invention is described based on the above embodiments, it should be clear that the contents of the present invention are not limited to specific examples described in detail in the above embodiments. For example, the following modifications are possible.

(1) Although not being specifically described in the above embodiments, the arc tube described in each of the above embodiments may be used in a compact self-ballasted fluorescent lamp by making the arc tube held by an arc tube holder, and combining the arc tube with a case containing a lighting circuit for lighting the arc tube and having a base at its end.

(2) Also, the arc tube described in each of the above embodiments may be covered by a translucent globe. A lamp using this arc tube covered by the translucent globe can prevent water drops from entering therein and therefore can be used outside. Further, such a lamp is free from damages caused by direct contact with the arc tube to detach or attach the lamp to or from an apparatus.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A discharge lamp, comprising:

an arc tube holder; and a double helical arc tube whose both ends are held by the arc tube holder, and that includes a turning part at a top thereof and two helical parts, the turning part joining the two helical parts together, wherein a tube diameter of the turning part gradually increases toward a middle of the turning part, in such a direction that narrows a non light-emitting region formed between the turning part and a neighboring portion of each helical part at the top of the arc tube, wherein a radius of curvature "R" at a joint of the turning part and each helical part, at a side of the non light-emitting region, is in a range of 1.8 to 2.0 inclusive.

2. The discharge lamp of claim 1, wherein when the double helical arc tube is formed by heating a glass tube and winding the glass tube around a tube-forming metal mold, a gas is blown into the glass tube to form the turning part.

3. The discharge lamp of claim 1, wherein an outer tube diameter of a glass tube that is used to form the double helical arc tube is in a range of approximately 9 to 10 mm, and an outer diameter of the two helical parts as viewed in a direction of the top of the arc tube is in a range of 30 to 40 mm inclusive.

4. A discharge lamp, comprising:

an arc tube holder; and a double helical arc tube whose both ends are held by the arc tube holder, and that has a turning part at a top thereof and two helical parts, the turning part joining the two helical parts together, wherein the turning part has a swelling part, to narrow a non light-emitting region formed between the turning part and a neighboring portion of each helical part at the top of the arc tube, and a radius of curvature "R" at a joint of the turning part and each helical part, at a side of the non light-emitting region, is in a range of 1.8 to 2.0 inclusive.

5. A discharge lamp, comprising:

an arc tube holder; and a double helical arc tube whose both ends are held by the arc tube holder, and that has a turning part at a top thereof and two helical parts, the turning part joining the two helical parts together, wherein at the top of the arc tube, a swelling part is provided on each helical part, to narrow a non light-emitting region formed between the turning part and a neighboring portion of each helical part at the top of the arc tube.

6. A discharge lamp, comprising:

an arc tube holder; and an arc tube that includes a plurality of U-shaped tubes placed on the arc tube holder, predetermined ones of the U-shaped tubes being connected together, to form a single discharge path therein, wherein each U-shaped tube has a swelling part at a top thereof that is an opposite side to the arc tube holder, to narrow a non light-emitting region surrounded by tops of the plurality of U-shaped tubes.

7. The discharge lamp of claim 6, wherein a swelling part of one U-shaped tube is apart from a swelling part of another U-shaped tube by at least 0.5 mm.

8. A discharge lamp, comprising:

an arc tube holder; and a double helical arc tube whose both ends are held by the arc tube holder, and that includes a turning part at a top thereof and two helical parts, the turning part joining the two helical parts together, wherein a tube diameter of the turning part gradually increases toward a middle of the turning part, in such a direction that narrows a non light-emitting region formed between the turning part and a neighboring portion of each helical part at the top of the arc tube, and a maximum outer tube diameter of the turning part is in a range of 12 to 14 mm inclusive.

9. A discharge lamp, comprising:

an arc tube holder; and a double helical arc tube whose both ends are held by the arc tube holder, and that includes a turning part at a top thereof and two helical parts, the turning part joining the two helical parts together, wherein a tube diameter of the turning part gradually increases toward a middle of the turning part, in such a direction that narrows a non light-emitting region formed between the turning part and a neighboring portion of each helical part at the top of the arc tube, and a maximum outer tube diameter of the turning part is larger than an outer tube diameter of an unprocessed glass tube by approximately 3 to 5 mm.

10. A discharge lamp, comprising:

an arc tube holder; and a double helical arc tube whose both ends are held by the arc tube holder, and that includes a turning part at a top thereof and two helical parts, the turning part joining the two helical parts together, wherein a tube diameter of the turning part gradually increases toward a middle of the turning part, in such a direction that narrows a non light-emitting region formed between the turning part and a neighboring portion of each helical part at the top of the arc tube, and the turning part and the neighboring portion of each helical part are apart from each other by 0.5 to 3.0 mm inclusive.

11. A discharge lamp, comprising:

an arc tube holder; and a double helical arc tube whose both ends are held by the arc tube holder, and that includes a turning part at a top thereof and two helical parts, the turning part joining the two helical parts together, wherein a tube diameter of the turning part gradually increases toward a middle of the turning part, in such a direction that narrows a non light-emitting region formed between the turning part and a neighboring portion of each helical part at the top of the arc tube, and an outer diameter of the two helical parts as viewed in a direction of the top of the arc tube is in a range of 30 to 40 mm inclusive.

12. A discharge lamp, comprising:

an arc tube holder; and a double helical arc tube whose both ends are held by the arc tube holder, and that includes a turning part at a top thereof and two helical parts, the turning part joining the two helical parts together, wherein the turning part has a swelling part, to narrow a non light-emitting region formed between the turning part and a neighboring portion of each helical part at the top of the arc tube, and a maximum outer tube diameter of the swelling part is in a range of 12 to 14 mm inclusive.

13. A discharge lamp, comprising:

an arc tube holder; and a double helical arc tube whose both ends are held by the arc tube holder, and that includes a turning part at a top thereof and two helical parts, the turning part joining the two helical parts together, wherein the turning part has a swelling part, to narrow a non light-emitting region formed between the turning part and a neighboring portion of each helical part at the top of the arc tube, and a maximum outer tube diameter of the swelling part is larger than an outer tube diameter of an unprocessed glass tube by approximately 3 to 5 mm.

14. A discharge lamp, comprising:

an arc tube holder, and a double helical arc tube whose both ends are held by the arc tube holder, and that includes a turning part at a top thereof and two helical parts, the turning part joining the two helical parts together, wherein the turning part has a swelling part, to narrow a non light-emitting region formed between the turning part and a neighboring portion of each helical part at the top of the arc tube, and the swelling part and the neighboring portion of each helical part are apart from each other by 0.5 to 3.0 mm inclusive.

15. A discharge lamp, comprising:

an arc tube holder; and a double helical arc tube whose both ends are held by the arc tube holder, and that includes a turning part at a top thereof and two helical parts, the turning part joining the two helical parts together, wherein the turning part has a swelling part, to narrow a non light-emitting region formed between the turning part and a neighboring portion of each helical part at the top of the arc tube, and an outer diameter of the two helical parts as viewed in a direction of the top of the arc tube is in a range of 30 to 40 mm inclusive.

* * * * *